US011434072B2

(12) United States Patent
Guarnieri

(10) Patent No.: US 11,434,072 B2
(45) Date of Patent: Sep. 6, 2022

(54) ACCESS CONTROL DEVICE, METHOD FOR CONTROLLING THE ACCESS TO A TANK

(71) Applicant: Paolo Guarnieri, Capannori (IT)

(72) Inventor: Paolo Guarnieri, Capannori (IT)

( * ) Notice: Subject to any disclaimer, the term of this patent is extended or adjusted under 35 U.S.C. 154(b) by 358 days.

(21) Appl. No.: 16/615,610

(22) PCT Filed: May 16, 2018

(86) PCT No.: PCT/IB2018/053412
§ 371 (c)(1),
(2) Date: Nov. 21, 2019

(87) PCT Pub. No.: WO2018/215886
PCT Pub. Date: Nov. 29, 2018

(65) Prior Publication Data

US 2020/0172329 A1 Jun. 4, 2020

(30) Foreign Application Priority Data

May 24, 2017 (IT) ..... 102017000056266

(51) Int. Cl.
*B65D 90/54* (2006.01)
*B65D 90/22* (2006.01)

(52) U.S. Cl.
CPC ..... *B65D 90/545* (2013.01); *B65D 90/22* (2013.01); *B65D 2590/0083* (2013.01); *B65D 2590/668* (2013.01)

(58) Field of Classification Search
CPC .... B65D 90/582; B65D 90/62; B65D 90/623; B65D 2590/0083; B65D 2590/666;
(Continued)

(56) References Cited

U.S. PATENT DOCUMENTS 2,684,779 A 7/1954 Rafferty
5,188,486 A 2/1993 Rhodes et al.
(Continued)

FOREIGN PATENT DOCUMENTS

WO 2009/087141 A1 7/2009

OTHER PUBLICATIONS

Italian Search Report and Written Opinion for corresponding Italian Patent Application: IT 102017000056266, eight pages, completed Jan. 22, 2018.

(Continued)

*Primary Examiner* — Anthony D Stashick
*Assistant Examiner* — Raven Collins
(74) *Attorney, Agent, or Firm* — Vorys, Sater, Seymour and Pease LLP

(57) ABSTRACT

An access control device for controlling access to a tank defining a storage chamber and access to the storage chamber; the device includes at least one cap and an external apparatus; the cap includes a closure body defining a closed position and an open position; a housing defining a housing volume for the closure body and a reciprocal rotation with respect to the closure body; a connection to connect the closure body to the housing, thereby defining an operating configuration in which said reciprocal rotation is prevented and a non-operating configuration in which it allows said reciprocal rotation, thus preventing said housing from controlling the passage of the closure body between the closed and open positions; and a data connector to provide wireless data connection with the external apparatus to allow it to control the passage of the connection between operating configuration and non-operating configuration.

14 Claims, 4 Drawing Sheets

(58) Field of Classification Search
CPC ..... B65D 2590/668; E05B 73/0041; E05B 73/05; E05B 73/04
See application file for complete search history.

(56) References Cited

U.S. PATENT DOCUMENTS

| | | | | |
|---|---|---|---|---|
| 10,180,018 | B1 * | 1/2019 | Simpson | A61J 1/18 |
| 2015/0225149 | A1 | 8/2015 | Greiner et al. | |

OTHER PUBLICATIONS

International Search Report for corresponding International PCT Application: PCT/IB2018/053412, four pages, dated Aug. 3, 2018.

* cited by examiner

ACCESS CONTROL DEVICE, METHOD FOR CONTROLLING THE ACCESS TO A TANK

The present invention relates to an access control device of the type specified in the preamble of the first claim.

In particular, the present invention relates to an access control device suitable for being used to control the opening of a tank and therefore to monitor the closing and opening of valves and filling manifolds of reservoir, tank, or other storage systems for fluids (liquefied or non-liquefied gases, petroleum products and petrochemicals in general). These storage systems are hereinafter simply referred to as tanks.

As is known, the way of some oil or petrochemical companies of marketing fuel provides that, through loan for use, property and all charges concerning maintenance, permits, ordinary and extraordinary tank management remain with the oil company. It thereby encourages the client, who therefore has no additional costs, to start an exclusive supply contract for a medium-long time span.

These tanks for combustion or automotive products are therefore mainly supplied through suitable motor vehicles which, by means of counting systems and related pipes, deliver the product through the filler, whether fitted with a valve or not, located on the tank itself.

The tanks, often owned by the same supplying company and granted in loan for use, permanently reside in places other than that of the property, in other words at the retailer's, distributor's, or even the same user customer's premises.

They consist of a housing suitable for containing special substances, and a valve, or filler/manifold, which can be closed by a cap easily accessible by a user.

The cap is generally a screw or bayonet cap.

As is known, the screw cap has a threaded support, which can be rotatably screwed or unscrewed from the tank. Therefore, the cap preferably has external threads that are compatible with the filler/manifold.

The bayonet cap is similar to the aforesaid screw cap and has substantially identical opening mechanisms. In addition, the cap comprises a portion entering the tubular support and adapted to slip out when the device is rotating.

The described prior art has a few major drawbacks.

In particular, the previously described closure devices do not allow a controllable closure of the tanks, which can easily be opened and made accessible even without the supplying company's authorization.

The previous devices do not guarantee an acceptable safety level even when access keys are provided.

In addition, the aforesaid systems, besides not guaranteeing high level of safety in terms of accessibility, do not allow the supplying company to check the integrity of the closure means used in its tanks.

In this context, the technical task underlying the present invention is to devise an access control device, which is capable of substantially obviating at least some of the above-mentioned drawbacks.

Within the scope of said technical task, a major object of the invention is to obtain an access control device which allows safety in terms of access to a tank or similar element to be increased.

Another major object of the invention is to provide an access control device which allows the supplying company, or user, or others, to continuously check the integrity thereof.

Accordingly, a further object related to the previous statements is to drastically reduce the number of possible unauthorized accesses to supply tanks.

The technical task and the specified objects are achieved by means of an access control device as claimed in the appended claim 1. Preferred embodiments are described in the dependent claims.

Preferred embodiments are set forth in the dependent claims.

The features and advantages of the invention will be apparent from the detailed description of preferred embodiments of the invention, with reference to the accompanying drawings, in which.

Figure 1:
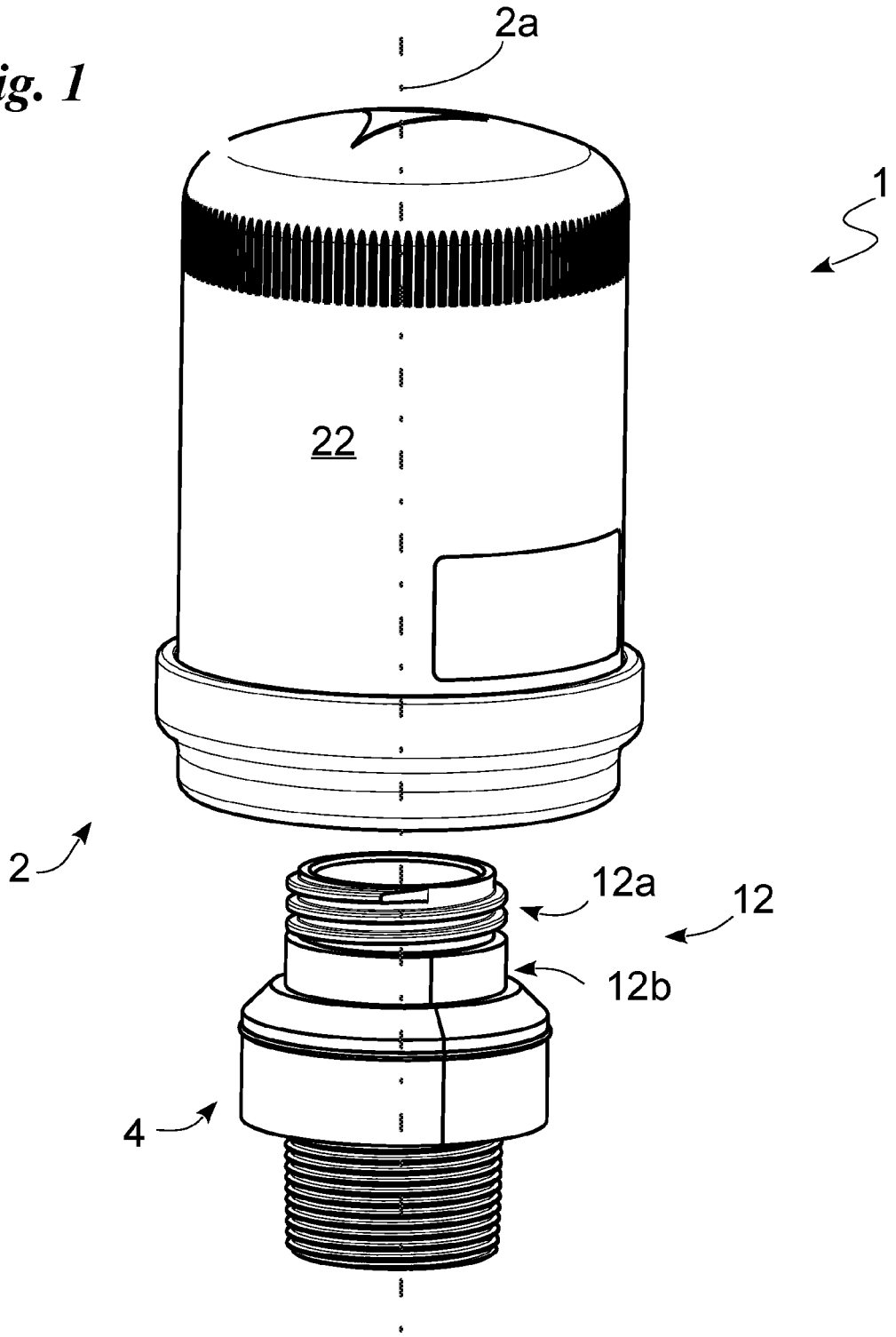
FIG. 1 shows a perspective view of the access control device according to the invention.

In the present document, the measures, values, shapes and geometric references (such as perpendicularity and parallelism), when associated with terms such as "about" or with other similar terms such as "almost" or "substantially", are to be understood as contemplating the possibility of measurement errors or inaccuracies due to production and/or manufacturing defects and, especially, contemplating the possibility of a slight difference in the value, measure, shape or geometric reference with which it is associated. For example, these terms, if associated with a value, preferably indicate a difference not exceeding 10% of the value itself.

Furthermore, when used, terms such as "first", "second", "higher", "lower", "main" and "secondary" do not necessarily identify an order, a priority relationship or a relative position, but can simply be used to distinguish more clearly the different components from each other.

The measurements and the data reported in this text are to be considered, unless otherwise indicated, as carried out in the International Standard Atmosphere ICAO (ISO 21533).

Unless otherwise specified, as is apparent from the following discussion, terms such as "treatment", "data processing", "determination", "calculation", or the like, are understood to refer to the action and/or processes of a computer or similar electronic computing device which manipulates and/or transforms data represented as physical, such as electronic sizes of registers of a computer system and/or memories, into other data similarly represented as physical quantities in computer systems, registers or other storage, transmission or information display devices.

With reference to the Figures, the access control device according to the invention is indicated as a whole by the numeral 1.

The access control device 1 is suitable for checking and monitoring accesses to a tank 10, i.e. when and by whom the tank 10 is opened.

The tank 10 is adapted to store a fluid (a gas and/or liquid) such as fuel. It can be, for example, a car tank or a tank designed to contain fuel and may therefore be an underground or a surface tank. Preferably, it is a tank designed to contain liquid and preferably fuel.

The tank 10 comprises at least one storage chamber 11 for said fluid; and at least one access 12 adapted to place the storage chamber 11 in fluidic through connection with the outside.

The access 12 comprises any opening or valve device or duct adapted to put the outside in communication with the storage chamber 11. It is identifiable as an external pipe fitting, a check valve, or preferably, a perforated and threaded connector adapted to allow the introduction and/or extraction of a fluid into/from the storage chamber 11.

The access 12 comprises an attachment 12*a* adapted to allow the access control device 1 to close the tank 10.

The attachment 12*a* may comprise interlocking shoulders, or preferably threads. The access 12 may comprise a duct 12*b* on which the attachment 12*a* is formed. The duct 12*b* protrudes from the chamber 11 towards the outside of the storage chamber 11.

The device 1 can comprise a cap 2 adapted to engage the access 12, thus closing the tank 10.

The cap 2 comprises a cap code identifying the cap itself.

The cap 2 defines a longitudinal axis 2*a* which can be substantially defined by the main direction of extension of the cap 2.

The cap 2 preferably comprises a closure body 21 adapted to define at least one closed position for the cap 2 in which the cap 2, and to be precise the closure body 21, are connected to the access 12, thereby closing the tank 10; and at least one open position in which the cap 2, and to be precise the closure body 21, are released from the access 12.

In the open position, the closure body 21 is released from the access 12, thus allowing removal of the cap 2 from the tank 10, which is thus accessible from the outside. In this position, fluid can be introduced or withdrawn into/from the storage chamber 11.

In the closed position, the closure body 21, and therefore the cap 2, are connected to the access mouth 12, thereby closing the tank 10 so as to make it inaccessible from the outside. In this position, fluid cannot be introduced or withdrawn into/from the storage chamber 11.

Preferably, in the closed position, the closure body 21 is connected to the tank 10, thereby defining a clamping force.

The transition between the closing and opening positions can be performed by moving the closure body 21 with respect to the access 12 suitably by rotation about the longitudinal axis 2*a*.

The closure body 21 preferably has shape and size compatible with the access 12.

In particular, it is substantially cylindrical, having as its axis the longitudinal axis 2*a*. The closure body 21 comprises means for connecting the closure body 21, and therefore the cap 2, to the access 12.

The connecting means may comprise at least one thread for engaging the thread of the attachment 12*a*.

The closure body 21 has a greater section than the section of the attachment 12*a*. These sections are calculated perpendicular to the longitudinal axis 2*a*.

The cap 2 may comprise a housing 22 defining a housing volume 22*a* for the closure body 21.

The housing 22 thus preferably defines the outer profile of the cap 2.

The housing volume 22*a* is adapted to house at least a portion of the closure body 21, and to be precise the entire closure body 21. In detail, the housing volume 22*a* houses the entire body 21 both in the closed position and in the open position.

The housing 22 can substantially have the shape of a cup. It therefore defines a housing volume 22*a* with a single open section adapted to allow a portion of the access 12 to be inserted in the housing volume 22*a* and become engageable with the closure body 21.

Figure 2:
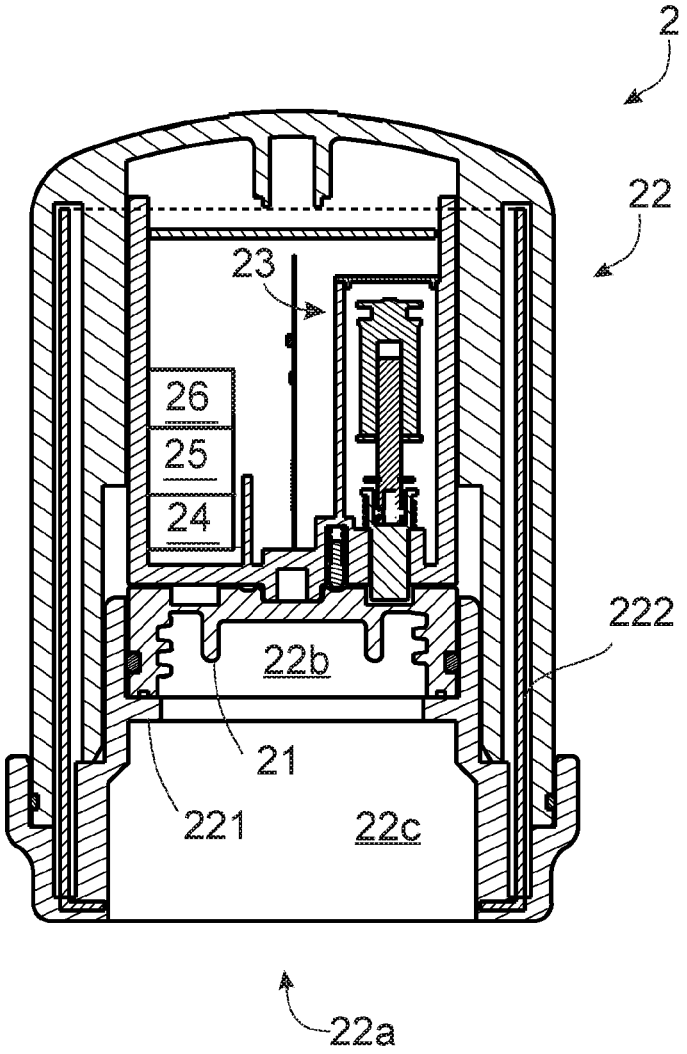
FIG. 2 shows a section of the device according to the invention.

Therefore, in the closed position, the housing 22 and in detail the housing volume 22*a* internally enclose the closure body 21 and at least part, and in detail almost the totality, of the duct 12*b* (FIG. 2).

The housing volume 22*a* comprises a first sub-volume 22*b* for the closure body 21 and a second sub-volume 22*c* comprising the open section. In detail, the housing 22 comprises an external rim 221 (FIG. 2) which divides the housing volume 22*a* into said first sub-volume 22*b* and said second sub-volume 22*c*.

The external rim 221 is identifiable as a ring inside the volume 22*a* and defining a passage opening between the sub-volumes 22*b* and 22*c*.

The section of the passage opening is smaller than that of the closure body 21 so as to prevent its passage from the first 22*b* to the second sub-volume 22*c*.

The section of the passage opening is greater than that of the access 12, which can therefore access the first sub-volume 22*c*.

In the closed position, the attachment 12*a* is in the first sub-volume 22*b* and the duct 12*b* is in the second sub-volume 22*c*. Optionally, a portion of the duct 12*b* is in the first sub-volume 22*b*.

The housing 22 and the closure body 21 are transiently connected to each other so as to mutually rotate about the longitudinal axis 2*a*. Preferably, the housing 22 and the body 21 define a single degree of freedom relative to one another, which is identified by said rotation.

The housing 22 may comprise a shield 222 for shielding at least the second sub-volume 22*c*, and in detail the whole inner housing volume 22*a*. Only the open section can be unshielded.

The shield 222 is adapted to prevent the cap 2 from being forced open, for example, by external agents such as blunt objects, flame cutting or the like.

It is made of metallic material such as manganese or steel, preferably highly alloyed steel.

The cap 2 may comprise a connection 23 suitable to connect the closure body 21 to the housing 22, thereby preventing their aforesaid reciprocal rotation about the axis 2*a*.

The connection 23 is adapted to integrally connect the closure body 21 to the housing 22.

It is placed in the housing volume 22*a*, in detail in the first sub-volume 22*b*, and still more precisely, on the opposite side of the rim 221 with respect to the closure body 21.

The connection 23 defines an operating configuration in which it connects the closure body 21 to the housing 22, thereby preventing their reciprocal rotation about the longitudinal axis 2*a*, and a non-operating configuration in which it does not connect the closure body 21 to the housing 22 and thus does not prevent the closure body 21 and the housing 22 from mutually rotating about the longitudinal axis 2*a*. In the operating configuration, the housing 22 and the closure body 21 are integral with each other and can move and rotate integrally. Therefore, in the operating configuration, the rotation of the housing 22 can control the transition of the closure body 21 between the closed and open positions.

In the non-operating configuration, mutual rotation of the housing 22 and the closure body 21 is permitted, therefore the housing 22 does not control the transition of the closure body 21 between the closed and open positions. In conclusion, when the connection 23 is in the non-operating configuration, the housing 22, if rotated, rotates with respect to the closure body 21, which remains almost stationary with respect to the access 12.

The connection 23 comprises at least one actuator, which is integral with the housing 22 and adapted to engage with and disengage from the closure body 21, thus defining the operating and non-operating configurations, respectively.

The actuator is linear, so as to define such configurations by varying its extension. More in particular, the actuator is electrical or preferably magnetic.

Figure 7:
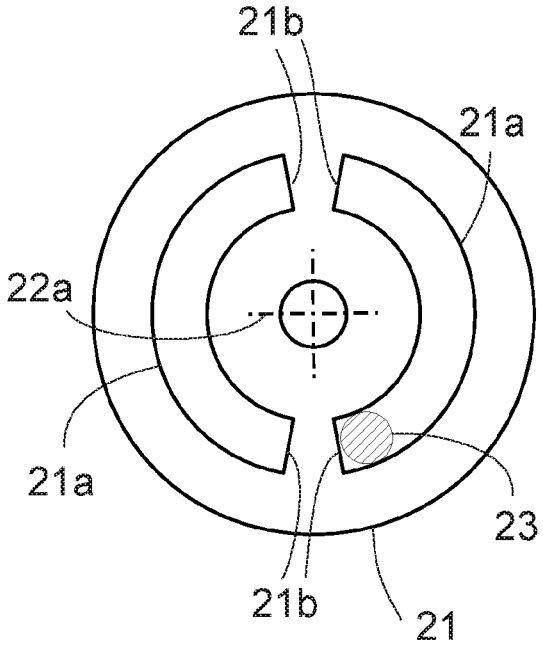
FIG. 7 shows a detail of the device.
Figure 8:
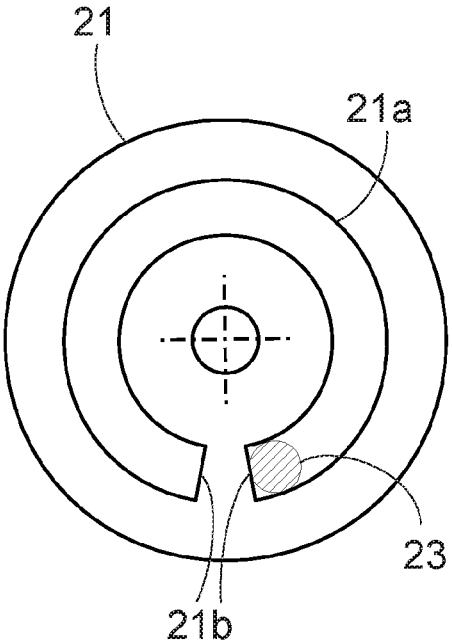
FIG. 8 shows a second example of the detail in FIG. 7.

In order for the actuator engagement to occur, the closure body 21 can comprise at least one cavity 21*a* in which the actuator fits in the operating configuration (FIGS. 7-8).

The cavity 21*a* may be annular with an angular extension of less than 360°, i.e. having a circularly extending axis centred on the axis 2*a* and extending along it for a range of less than 360°. In this case, the connection 23 provides the operating configuration by fitting in the cavity 21*a* and rotating therein until it abuts against an end-stop face 21*b* of the annular cavity 21*a* transverse to the circularly extending axis.

Preferably, the closure body 21 comprises a single annular cavity 21*a* with an angular extension of less than 360° (FIG. 8). Alternatively, it provides two annular cavities 21*a*, each having an angular extension of less than 180° (FIG. 7).

Figure 6:
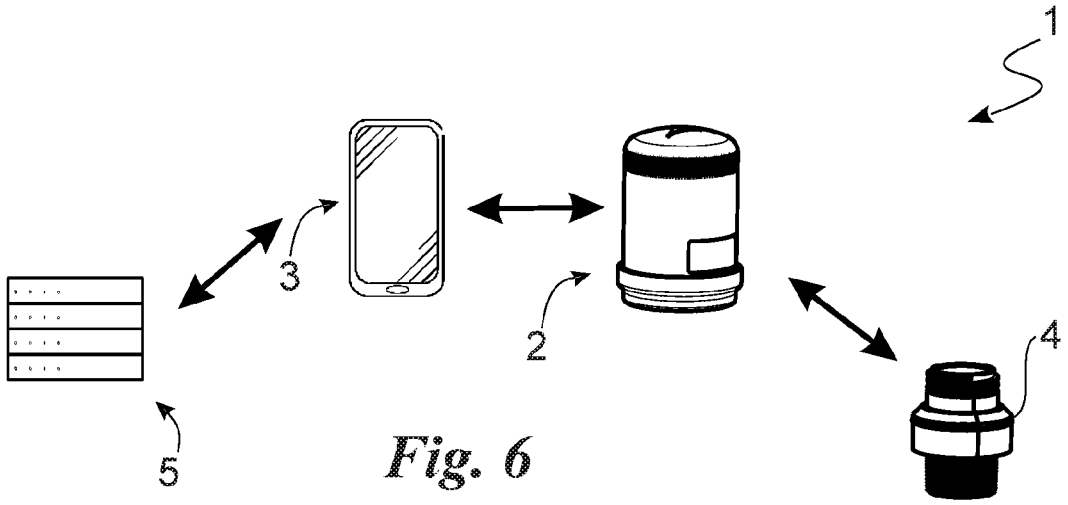
FIG. 6 is a diagram of the access control device according to the invention.

The cap 2 may comprise data connection means 24 adapted to provide a (suitably wireless) data connection, and the access control device 1 can be associated with at least one external apparatus 3 (FIG. 6) adapted to establish a data connection with the data connection means 24 so as to control the transition of the connection 23 between the operating and non-operating configurations.

The access control device 1 comprises the at least one external apparatus 3.

The external apparatus 3 may be a portable electronic device (for example of the type known, such as a smartphone) adapted to send and receive data to/from the data connection means 24.

Preferably, the wireless data connection between the external apparatus 3 and the data connection means 24 (i.e. the cap 2) can be encrypted.

The data connection means 24 are in data connection with the connection 23, thereby commanding said change of configuration thereof. This connection can be made by cables and physical connections (such as the control board described below).

The data connection means 24 are placed in the housing volume 22*a*, in detail in the first sub-volume 22*b*, and still more precisely, on the opposite side of the rim 221 with respect to the closure body 21.

The cap 2 may comprise a detection system 25 for detecting the movements of the housing 22 resulting, for example, from external inputs such as knocks or rotations around the axis 2*a*.

The detection system 25 may comprise at least one of an accelerometer and a gyroscope. Preferably, it comprises at least one accelerometer and at least one gyroscope.

The detection system 25 is integral with the housing 22, and in particular placed in the housing volume 22*a*, and more precisely in the first sub-volume 22*b*, and still more precisely, on the opposite side of the rim 221 with respect to the closure body 21.

The cap 2 may comprise a memory 26.

The memory 26 is adapted to store the data detected by the detection system 25.

Preferably, the memory 26 is adapted to contain the cap identification code.

The memory 26 is placed in the housing volume 22*a*, and more precisely in the first sub-volume 22*b*, and still more precisely, on the opposite side of the rim 221 with respect to the closure body 21.

The cap 2 can comprise a control board for controlling the operation of the cap 2.

The control board is in data connection with at least one of the connection 23, the data connection means 24, the detection system 25 and the memory 26, so as to control the operation thereof and allow them to exchange data with each other.

Preferably, the control board is in data connection with all the aforesaid electronic components.

The control board is placed in the housing volume 22*a*, and more precisely in the first sub-volume 22*b*, and still more precisely, on the opposite side of the rim 221 with respect to the closure body 21.

The cap 2 may comprise a cap power supply 27.

The power supply 27 is adapted to supply said electronic components of the cap 2.

It may consist of a long-life battery of a known type, for example a lithium battery.

The power supply 27 is preferably placed in the housing volume 22*a*, and more precisely in the first sub-volume 22*b*, and still more precisely, on the opposite side of the rim 221 with respect to the closure body 21.

The access control device 1 may comprise a clamping element 4 adapted to be connected to the tank 10, and in particular to the access 12.

Preferably, the clamping element 4 is adapted to be suitably integrally connected to the duct 12*b* so as to be arranged, when the cap 2 is in the closed position, in the housing volume 22*a*, and more precisely in the second sub-volume 22*c*.

The clamping element 4 can comprise two half-rings mutually connectable in an unresolvable manner.

The clamping element 4 is substantially shaped complementarily to the second sub-volume 22*c* so as to substantially fill the space between the housing 22 and the access 12. It favours the passage of the cap 2 into the closed position.

Figure 5:
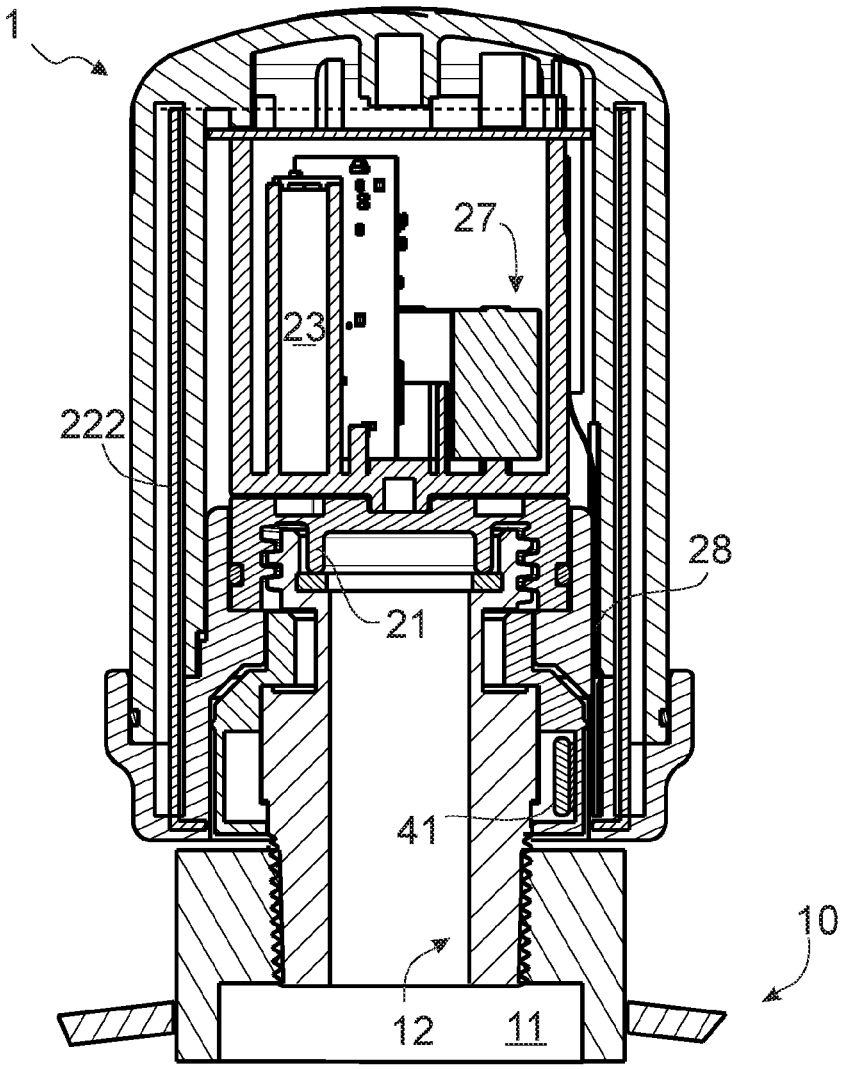
FIG. 5 shows a second section of the device.

The clamping element 4 can comprise a readable medium 41 bearing the tank code identifying the tank 10, and the cap 2 can comprise a reading system 28 for reading the tank code in the clamping element 4 (FIG. 5).

The readable medium 41 is integral with the clamping element 4, and in detail integrated into the clamping element 4.

It is identifiable as a short-range communication device (SRD) such as an NFC or an RFID. In particular, the readable medium 41 may be a preferably passive RFID.

The reading system 28 can be an antenna compatible with the readable medium 41.

The reading system 28 is in data connection with the data connection means 24 so that the tank code read by the reading system 28 can be transmitted to the external apparatus 3.

The reading system 28 may be integral with the housing 22.

The reading system 28 may be adapted to read the tank code only when it is superimposed on the readable medium 41 radially with respect to the longitudinal axis 2*a*, i.e. along an axis perpendicular to the longitudinal axis 2*a*.

It is adapted to perform the reading of the tank code exclusively when the cap 2 is in the closed position. It is positioned where the second sub-volume 22*c* is located. The reading system 28 is placed between the shield 222 and the housing volume 22*a*, and to be precise between the shield 222 and the second sub-volume 22*c*. The shield 222 can thus act as a barrier to the reading of the tank code by preventing a reading device outside the cap 2 from reading said tank code. In particular, the shield 222 is adapted to enable the reading by the reading system 28 only when the reading system 28 is in the second sub-volume 22*c*.

Suitably, the shield 222 may comprise an external contouring of the open section, i.e. a portion protruding in an internal and radial direction with respect to the rest of the shield 222 located at the open section.

It should be noted that the shield 222 prevents the reading of the tank code but not the connection between the data connection means 24 and the external apparatus 3. To this end, the shield 222 may be perforated and have one or more openings at least in the vicinity of the data connection means 24.

Lastly, the cap 2 may comprise safety means 29 adapted to prevent the transition of the cap 2 into the open position when the connection 23 is in the non-operating configuration.

The safety means 29 are adapted to generate, when the cap 2 is in the closed position, a safety force between the tank 10 and one of the housing 22 and the closure body 21 (i.e. safety between the tank 10 and the housing 22 and/or safety between the tank 10 and the closure body 21) greater than the frictional force between the housing 22 and the closure body 21 in the non-operating configuration.

Preferably, the safety means 29 are adapted to generate said safety force between the tank 10 and the housing 22.

This safety force is therefore greater than the frictional force that can be generated as a result of the presence of any internal friction between the housing 22 and the closure body 21 when the connection 23 is in the non-operating configuration. These internal frictions can be due to sealing rings or other elements interposed between the housing 22 and the closure body 21.

The safety means 29 can, for example, exploit the clamping force between the closure body 21 and the access 12 to create said safety force.

Figure 3:
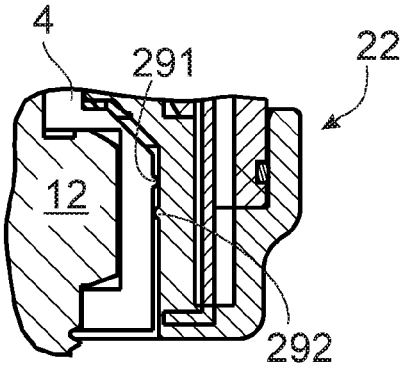
FIG. 3 is a detail of the device.
Figure 4:
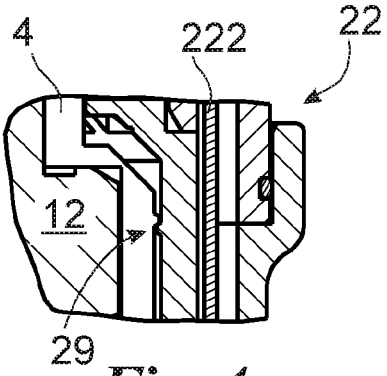
FIG. 4 shows a second view of the detail in FIG. 3.

Alternatively, the safety means 29 (FIGS. 3 and 4) may comprise a first obstruction 291 connected to, and in detail integral with the access 12, and precisely with the clamping element 4, and a second obstruction 292 connected to, and in detail integral with the housing 22.

The first obstruction 291 is identifiable as a ring (or other means) protruding radially outwards, and in detail towards the housing 22.

The second obstruction 292 is identifiable as a ring (or other means) protruding radially inside the housing 22, i.e. towards the clamping element 4.

The second obstruction 292 is proximal to the open section of the housing 22 so as to place itself between the first obstruction 291 and the open section when the cap 2 is in the closed position. In detail, the second obstruction 292 is positioned where the second sub-volume 22*c* is located, in the vicinity of the open section of the housing 22.

The obstructions 291 and 292 are designed to go into mutual interference (FIG. 4) during transition between the open and closed positions, and precisely at least during the passage from the closed position to the open position.

The maximum diameter of the first obstruction 291 is at least equal to the minimum diameter of the second obstruction 292. Accordingly, when the cap is in the closed position and the connection 23 is in the non-operating configuration, the interference between the obstructions 291 and 292 prevents the rotation of the housing 22 from causing, due to said internal friction, a rotation of the closure body 21 and therefore the opening of the tank 10. In particular, the housing 22 can rotate the closure body 21 with respect to the access 12 until the obstructions 291 and 292 interfere with one another, thus preventing further rotation of the closure body 21 with respect to the access 12.

The cap 2 may comprise geolocation devices suitable to allow the position of the cap 2 and therefore of the tank 10 to be identified.

Lastly, the access control device 1 can be associated with, and in detail comprises a remote server 5 adapted to establish a data connection with the external apparatus 3.

The remote server 5 is designed to establish a data connection with the cap 2 through the external apparatus 3. The external apparatus 3 acts as a data connection link between the remote server 5 and the cap 2.

Alternatively or additionally, the remote server 5 is suitable to establish a data connection with the cap 2 through a link unit suitable to establish a data connection with both the cap 2 and the remote server 5. This link unit can be distinct from the external apparatus 3.

The remote server 5 comprises a caps database linking each cap code to a tank code, and suitably to a command code for the connection 23. The command code may be temporary. It is characterised by a predefined validity time in which it can be used for controlling the cap 2.

Suitably, the date of each passage into the closed position and the open position of the caps 2 is stored in the caps database.

The external apparatus 3 may comprise a geolocation device suitable to allow the position of the cap 2 and therefore of the tank 10 to be identified. In particular, the external apparatus 3 can detect the position of the cap 2, and therefore of the tank 10, according to its own position when it establishes a data connection with the cap 2. This position may be stored in the apparatus 3 and/or sent to the remote server 5.

Alternatively or additionally, the link unit may comprise one of said geolocation device.

The operation of the access control device 1, previously described in structural terms, is as follows. In particular, this operation results in a new method for controlling the access to a tank 10, which can be actuated by said access control device 1.

The access control method mainly comprises a step of opening the tank 10 and a step of closing the tank 10.

In the opening step, the external apparatus 3 establishes a data connection with the cap 2 and controls the transition of the connection 23 from the non-operating to the operating configuration so that the rotation of the housing 22 rotates the closure body 21, thereby bringing the cap 2 from the closed to the open position.

In particular, the opening step comprises a connection sub-step in which the external apparatus 3 receives the cap code from the cap 2; an additional connection sub-step in which the external apparatus 3 connects to the remote server 5 and sends it said cap code; a creation sub-step in which the remote server 5, on the basis of the caps database, generates the command code and sends it to the apparatus 3; a sending sub-step in which the external apparatus 3 sends said command code to the cap 2; and a fastening sub-step in which the connection 23 passes from the non-operating to the operating configuration.

Alternatively, the opening step provides that in the creation sub-step the remote server 5 generates one or more command codes for one or more caps 2 and sends to the apparatus 3 said command codes, each of which is associated with its own cap code so that the apparatus 3 receives the command code before reaching the tank 10 and connecting to the cap 2. Subsequently, in the connection sub-step the external apparatus 3 receives the cap code from the cap 2; and in the sending sub-step the apparatus 3 identifies the command code associated with the cap code previously received and sends the identified command code to the cap 2, thus allowing the subsequent fastening sub-step. The additional connection sub-step can thus be omitted.

At this point, the housing 22 is rotated, thereby dragging the closure body 21 until the cap 2 reaches the open position.

Now an operator can, for example, fill the tank 10.

Once this operation is finished, the closing step begins, in which the housing 22 is rotated, thereby dragging the closure body 21 until the cap 2 reaches the closed position, thus closing the tank 10.

It should be noted that the transition into the closed position causes the second obstruction 292 to pass over the first obstruction 291 and place itself between said first obstruction 291 and the open section.

Once the cap 2 is in the closed position, the closing step provides that the external apparatus 3 sends the command code to the cap 2, thereby commanding the connection 23 to pass into the non-operating configuration.

At this point, the control method can provide a step of confirming the closure of the tank 10 through the reading of the tank code by the cap 2, and then of sending said code tank to the remote server 5 through the external apparatus 3.

In detail, the confirmation step comprises a reading sub-step in which the housing 22 rotates, thereby radially superimposing the reading system 28 over the readable medium 41, which reading system 28 thus reads the tank code; and a data transfer sub-step in which the cap 2 connects to the remote server 5 through the external apparatus 3 so as to send it said tank code to confirm that the tank 10 is closed.

The remote server 5 will then update the caps database with the date of transition into the closed and open positions of the cap 2.

It should be noted that in the reading sub-step, since the connection 23 is in the non-operating configuration, the closure body 21 remains stationary while the housing 22 rotates.

The access control device 1 according to the invention achieves important advantages.

In fact, the access control device 1 makes it possible to increase the safety of the closure means provided on tanks for use as described above.

Access to the connection 23, in fact, is carried out exclusively through external apparatuses coordinated by codes, and it is in no way possible to access the inside of the device 1, and therefore to access any areas susceptible of being forced open.

The detection system 25 also allows any movements of the device during the non-operating phase, i.e. when no external device 3 is connected to the connection means 24, to be entered into the memory 26, i.e. the electronic support.

Therefore, the device 1 allows continuous control and monitoring of the integrity of the cap 2 with, in addition, the possibility to investigate the entered data and, therefore, for example the date of the opening attempt and the movements performed.

A further advantage is that the various electronic components of the cap are enclosed within the housing 22, and therefore the only possible connection between the cap 2 and an external object is a wireless connection.

In fact, the cap 2, also due to the presence of the memory 26, the connection means 24 and/or the power supply 27 in the housing volume 22*a*, can be devoid of physical connectors (data and/or power supply connectors such as a USB port), making it difficult to tamper with the cap 2.

Accordingly, the device 1 allows the number of possible unauthorized accesses to the tanks to be drastically reduced.

Moreover, the access control device 1 can also be used with known tanks, without any modification thereof.

The invention is susceptible of variations falling within the scope of the inventive concept as defined by the claims. In this context, all details are replaceable by equivalent elements, and the materials, shapes and dimensions may be any materials, shapes and dimensions.

The invention claimed is:

1. An access control device for controlling the access to a tank, said tank defining a storage chamber and an access to said storage chamber, and said device comprising at least one cap of said tank defining a longitudinal axis; said cap comprising:

a closure body rotatable about said longitudinal axis defining a closed position for said cap in which said closure body is connected to said access, thereby closing said tank, and an open position in which the closure body is released from said access, thereby opening said tank;

a housing defining a housing volume for said closure body, wherein said closure body and said housing defines a reciprocal rotation around said longitudinal axis; and a connection adapted and configured to transiently connect said closure body to said housing, said connection having:

an operating configuration in which said connection connects said closure body to said housing to prevent said reciprocal rotation between said closure body and said housing and allow said housing to command the passage of said closure body between said closed and open positions, and a non-operating configuration in which said connection does not connect the closure body to the housing and allows said reciprocal rotation between said closure body and said housing, thereby preventing said housing from commanding the passage of said closure body between said closed and open positions; and a data connector in data communication with the connection and adapted and configured for wireless data connection with an external apparatus configured to realize said wireless data connection with said data connector so as to command the passage of said connection between said operating configuration and said non-operating configuration.

2. The access control device according to claim 1, wherein said cap comprises a detection system configured to detect the movements of said housing.

3. The access control device according to claim 2, wherein said detection system is located in said housing volume and comprises, integral with said housing, at least one of an accelerometer and a gyroscope.

4. The access control device according to claim 2, wherein said cap comprises a memory configured to store the data detected by said detection system and placed in said housing volume; and wherein said cap is configured to send said data detected by said detection system to said external apparatus when said data connector is in data communication with said external apparatus.

5. The access control device according to claim 1, wherein said cap comprises safety means configured to generate, when said cap is in a closed position and said connection is in said non-operating configuration, a safety force between said tank and one between said housing and said closure body greater than the frictional force between said housing and said closure body, thereby preventing said cap from passing into said open position.

6. The access control device according to claim 5, wherein said safety means comprise a first obstruction connected to said access and a second obstruction connected to said housing and suitable to place itself in the closed position between said first obstruction and said storage chamber; said obstructions configured to go into mutual interference during the passage between said closed position and said open position.

7. The access control device according to claim 1, wherein said cap comprises a power supply to said cap housed in said housing volume and comprising at least one long life battery.

8. The access control device according to claim 1, wherein said access comprises a duct configured to be at least partially housed in said housing volume when said cap is in said closed position; wherein said access control device comprises a clamping element comprising a readable medium bearing an identification code of said tank; wherein said clamping element is configured to be connected to said duct so that said readable medium is in said housing volume when said cap is in said closed position; and wherein said cap comprises a reading system for reading said readable medium located at said housing volume so as to read said readable medium only when said cap is in said closed position.

9. The access control device according to claim 8, wherein said housing comprises a shield for said housing volume and wherein said reading system is between said housing volume and said shield so that when said cap is in said closed position said reading of said readable medium can be performed exclusively by said reading system.

10. The access control device according to claim 1, wherein said housing comprises a shield for said inner housing volume configured to prevent said cap from being forced open and wherein said shield is made of one of manganese and highly alloyed steel.

11. A method for controlling the access to a tank comprising an access control device according to claim 1, wherein an opening step of said tank in which said external apparatus connects to said data connector and commands the passage of said connection from said non-operating configuration to said operating configuration, thus allowing the passage of said cap into said open position by rotation of said housing and said closure body integral with said housing; and a closing step of said tank wherein, when said cap is in said closed position, said external apparatus connects to said data connector and commands the passage of said connection from said operating configuration to said non-operating configuration, thus preventing said rotation of said housing from rotating said closure body.

12. The access control device according to claim 1, wherein said connection comprises an actuator movable between a first position and a second position, in the first position the actuator connects said closure body to said housing to place said connection in the operating configuration, in the second position the actuator places said connection in the non-operating configuration by not connecting said closure body to said housing.

13. The access control device according to claim 12, wherein said actuator is axially movable between a first position and a second position.

14. The access control device according to claim 1, wherein said connection is integral with the housing and comprises an actuator movable between a first position and a second position to engage with and disengage from the closure body;

in the first position the actuator connects said closure body to said housing to place said connection in the operating configuration, in the second position the actuator places said connection in the non-operating configuration by not connecting said closure body to said housing.

* * * * *